US009546837B1

(12) United States Patent
Yumshtyk

(10) Patent No.: US 9,546,837 B1
(45) Date of Patent: Jan. 17, 2017

(54) ADVANCED GUN BARREL

(71) Applicant: BH5773 LTD, Hollywood, FL (US)

(72) Inventor: Gennady Yumshtyk, Hollywood, FL (US)

(73) Assignee: BH5773 LTD, Hollywood, FL (US)

( * ) Notice: Subject to any disclaimer, the term of this patent is extended or adjusted under 35 U.S.C. 154(b) by 0 days.

(21) Appl. No.: 14/879,371

(22) Filed: Oct. 9, 2015

(51) Int. Cl.
*F41A 21/20* (2006.01)

(52) U.S. Cl.
CPC ..... *F41A 21/20* (2013.01)

(58) Field of Classification Search
CPC ..... F41A 21/02; F41A 21/04; F41A 21/20; F41A 21/22
USPC ..... 42/76.02, 76.1, 78
See application file for complete search history.

(56) References Cited

U.S. PATENT DOCUMENTS

| | | | | |
|---|---|---|---|---|
| 2,792,657 | A | 5/1957 | Slowter | |
| 2,859,157 | A * | 11/1958 | Curtiss, Jr. | C25D 7/04 204/224 R |
| 3,261,121 | A | 7/1966 | Eves | |
| 3,346,379 | A | 10/1967 | Rhodin | |
| 3,549,427 | A | 12/1970 | Rausch et al. | |
| 3,607,251 | A | 9/1971 | Ostermann | |
| 4,407,713 | A | 10/1983 | Zega | |
| 4,409,881 | A | 10/1983 | van der Wielen | |
| 4,419,202 | A | 12/1983 | Gibson | |
| 4,577,431 | A | 3/1986 | Siemers et al. | |
| 4,669,212 | A | 6/1987 | Jackson et al. | |
| 4,799,977 | A | 1/1989 | Rausch | |
| 4,963,240 | A | 10/1990 | Fukasawa et al. | |
| 5,476,581 | A * | 12/1995 | Reckeweg | F41A 21/04 205/122 |
| 5,486,242 | A | 1/1996 | Naka et al. | |
| 5,935,351 | A | 8/1999 | Sherman et al. | |
| 6,193,853 | B1 | 2/2001 | Yumshtyk et al. | |
| 6,352,740 | B1 | 3/2002 | Warnecke et al. | |
| 6,365,011 | B1 * | 4/2002 | Yumshtyk | C23C 14/35 204/192.12 |
| 6,436,252 | B1 | 8/2002 | Tzatzov et al. | |

(Continued)

FOREIGN PATENT DOCUMENTS

| | | |
|---|---|---|
| CN | 103146974 | 12/2015 |
| EP | 0 285 130 | 10/1988 |

(Continued)

OTHER PUBLICATIONS

Audino (2006) "Use of Electroplated Chromium in Gun Barrels," [online] [retrieved Nov. 25, 2009] Retrieved from the Internet: <URL:http://www.asetsdefense.org/documents/workshops/mfw-5-06/backgroundreports/6-gun_barrels-mike_audino.pdf>.

(Continued)

*Primary Examiner* — Bret Hayes
(74) *Attorney, Agent, or Firm* — Lathrop & Gage LLP

(57) ABSTRACT

Coated gun barrels comprising a metallic coating on the inner surface or bore surface of the gun barrel are provided, the coating comprising a first metallic component, molybdenum and optionally titanium. The first metallic component may be tantalum (Ta), niobium (Nb), zirconium (Zr), rhenium (Re), hafnium (Hf), tungsten (W) or combinations thereof. The coated gun barrels can display improved fatigue, thermal resistance, corrosion resistance, erosion resistance, crack resistance and/or wear resistance as compared to uncoated gun barrels, conventionally coated gun barrels or gun barrels with inserts.

31 Claims, 6 Drawing Sheets

(56) References Cited

U.S. PATENT DOCUMENTS

| | | | | |
|---|---|---|---|---|
| 6,889,464 | B2 | 5/2005 | Degerness | |
| 7,650,710 | B1 * | 1/2010 | Conroy | F41A 21/22 148/207 |
| 7,721,478 | B2 | 5/2010 | Withers et al. | |
| 8,177,947 | B2 | 5/2012 | Miyashita | |
| 8,349,249 | B2 | 1/2013 | Wachter et al. | |
| 8,409,498 | B2 | 4/2013 | Inoue et al. | |
| 2001/0025796 | A1 * | 10/2001 | Schlenkert | F41A 21/22 205/108 |
| 2004/0140292 | A1 * | 7/2004 | Kelley | B23K 9/048 219/76.13 |
| 2005/0280977 | A1 | 12/2005 | Kirihara et al. | |
| 2009/0145743 | A1 | 6/2009 | Yumshtyk et al. | |
| 2014/0262750 | A1 | 9/2014 | Yumshtyk et al. | |
| 2015/0318152 | A1 | 11/2015 | Yumshtyk et al. | |

FOREIGN PATENT DOCUMENTS

| | | |
|---|---|---|
| JP | H01-111833 | 4/1989 |
| JP | H07-054139 | 2/1995 |
| WO | WO 02/05863 | 1/2002 |

OTHER PUBLICATIONS

Burton et al. (2004) "Army Targets Age Old Problems with New Gun Barrel Materials," AMPTIAC Quarterly, 8(4), 49.

Lee et al. (2006), "Electroplated and Plasma Enhanced Magnetron Sputtered Ta and Cr Coatings for High Temperature and High Pressure Operation", MRS Proceedings, vol. 987, [online] [retrieved Aug. 11, 2016] Retrieved from the Internet: <URL: http://journals.cambridge.org/action/displayAbstract?fromPage=online&aid=8162831&fileId=S1946427400061613> <DOI: http://dx.doi.org/10.1557/PROC-987-0978-PP03-13>, Abstract only.

Levy et al. (Oct. 2008) "Investigation of Chemically Vapor Deposited Tantalum for Medium Caliber Gun Barrel Protection (WP-1425)," New Jersey Institute of Technology. [online] [retrieved May 12, 2014] Retrieved from the Internet: <URL: https://www.serdp-estcp.org/Program-Areas/Weapons-Systems-and-Platforms/Surface-Engi neering-and-Structural-Materials/Coatings/WP-1425/WP-1425>.

Matson et al. (Oct. 2001) "Properties of Thick Sputtered Tantalum used for Protective Gun Tube Coatings," US Army Armament Research, Development and Engineering Center. Technical Report ARCCB-TR-01019.

Mulligan et al. (2006), "Characterization and Comparison of Magnetron Sputtered and Electroplated Gun Bore Coatings", J. Pressure Vessel Technol. 128(2) 240.

Rusch (2003) "Tri-Service Green Gun Barrel" [online] [retrieved Nov. 24, 2009] Retrieved from the Internet: <URL: www.dtic.mil/cgi-bin/GetTRDoc?AD=ADA48220 >.

* cited by examiner

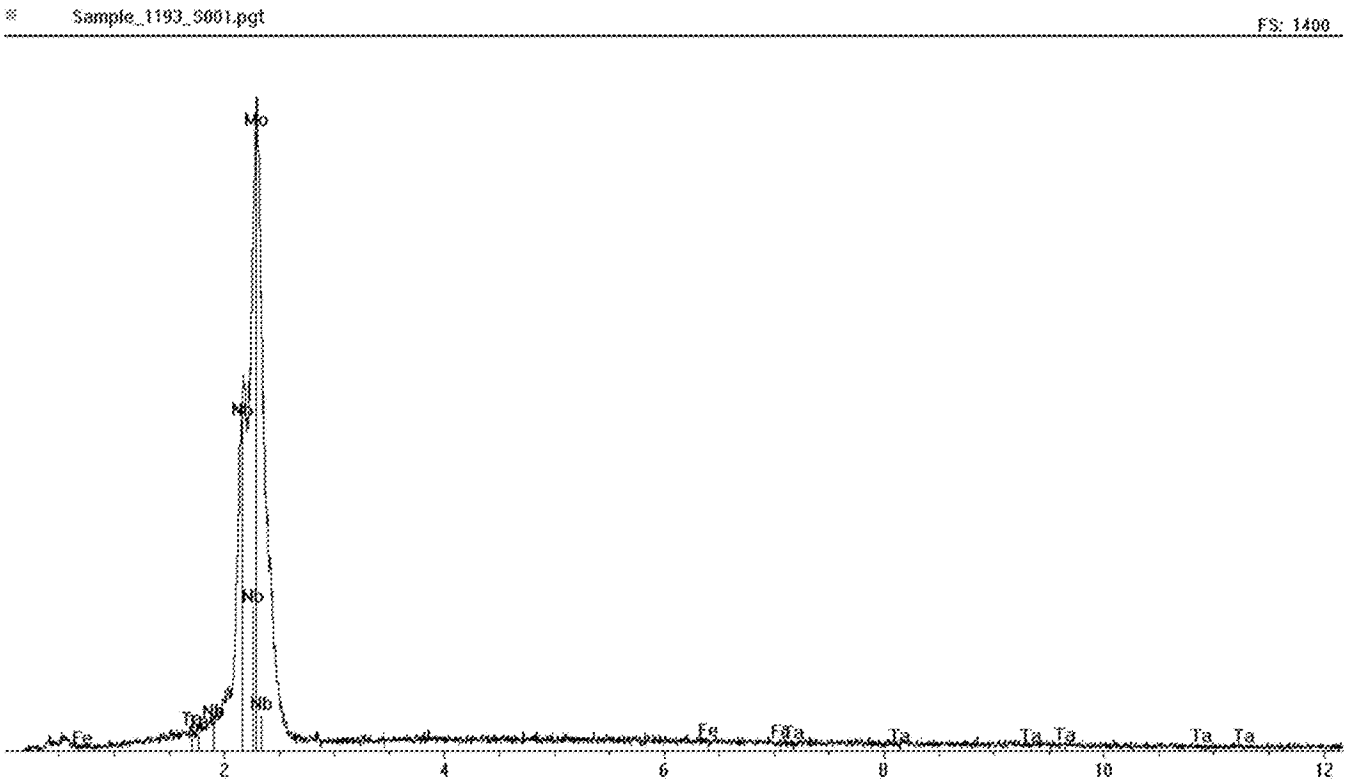
Sample_1193_3001.pgt
FS: 1400
Mo
Nb
Ta
Ta
Ta

ADVANCED GUN BARREL

CROSS-REFERENCE TO RELATED APPLICATIONS

Not Applicable

BACKGROUND OF THE INVENTION

As referred to herein, gun barrels or tubes are generally tubular structures through which projectile is fired. Gun barrels may have a smooth bore or be rifled to impart spin and stabilize the projectile being fired. Rifling may take the form of helical grooves formed in the barrel of the gun with groves having sharp or round edges. Polygonal rifling can also be used. Both forms of rifling create helical surface features on the interior of the gun barrel and may be produced by cutting, broaching, hammer-forging, flow-forming, electro-chemical etching or any other surface-shaping or forming technique.

The life of high performance gun barrels is typically limited by their fatigue, wear and erosion characteristics. Thermal impact and structural loading, such as heat and pressure generated by ignition and burning of the propellant, can cause damage to or failure of the gun barrel. The internal surface of gun barrels is also subjected to fatigue, wear and corrosion which elevate with the firing of each projectile. In many cases the need for a reasonable barrel life will limit the overall system performance by precluding modern propelling charge solutions which provide increased performance at the cost of increased barrel fatigue, wear or erosion.

A variety of methods to form protective surface layers on bores of steel gun barrels are known to the art. The nitriding and carburizing processes can be used; typically a very thin surface compound layer and a deeper metallurgically-modified zone are formed. Mechanical inserts made from Stellite™ (a cobalt-based alloy), Inconel™ (a nickel-chromium based alloy) or other high-performance materials are known to be used in gun barrels to subside impact to barrel steel. Steel gun barrels are commercially coated with galvanic chromium to improve the wear resistance of the barrel. Coating of a bore surface of a gun barrel with tantalum is described in U.S. Pat. No. 2,792,657. Explosively welded protective cladding of a gun barrel bore is described in U.S. Pat. No. 3,261,121; the cladding may be of a refractory metal having a melting point higher than chromium.

BRIEF SUMMARY OF THE INVENTION

In one aspect, the invention provides coated gun barrels comprising a metallic coating on the inner surface or bore surface of the gun barrel, the coating comprising a first metallic component, molybdenum and optionally titanium. The first metallic component may be tantalum (Ta), niobium (Nb), zirconium (Zr), rhenium (Re), hafnium (Hf), tungsten (W) or combinations thereof. In a further aspect the invention provides coated gun barrels comprising a coating disposed on the surface of the gun barrel, the coating comprising a metallic region disposed on the inner surface of the gun barrel and a non-metallic region such as an oxidized, nitrided or carburized region at the surface of the coating. The coated gun barrels of the invention may display improved performance as compared to uncoated gun barrels, nitrided gun barrels, gun barrels with inserts or gun barrels coated with chromium coatings. For example, the coated gun barrels of the present disclosure can display improved fatigue, thermal resistance, corrosion resistance, erosion resistance, crack resistance and/or wear resistance as compared to uncoated gun barrels, conventionally coated gun barrels or gun barrels with inserts.

In some embodiments, the metallic coating is uniform in properties across its thickness. In other embodiments, the metallic coating varies in properties across its thickness. In an example, the variation in the property or properties across the thickness of the coating is gradual, so that the coating is graded. In different embodiments, the thickness of the coating is from 10 μm to 2000 μm, 10 μm to 100 μm or 100 μm to 2000 μm. The coating may be viewed as having an inner region adjacent to the interface of the coating with the gun barrel, an outer region adjacent to the surface of the coating and a center region containing the midpoint of the coating thickness. In an embodiment, the inner region, the outer region and the central region are each approximately one third the coating thickness. In an embodiment, inner surface of the gun barrel is rifled and inner surface of the coated gun barrel (e.g. the coating surface) retains rifling surface features.

In an example, the hardness of the coating varies with thickness in the coating. In different examples, the hardness of the coating increases with distance from the interface between the coating and the gun barrel, decreases with distance from the interface between the coating and the gun barrel, or is harder in the central portion of the coating than at either the surface of the coating or at its interface with the gun barrel. In embodiments, the increase or decrease in hardness is gradual, such as an increase or decrease of less than 18 on the Knoop scale (HK) over a distance of 10 micrometers. In an embodiment, the hardness of the coating surface is from 360 Knoop to 1400 Knoop, 360 Knoop to 800 Knoop or 800 Knoop to 1400 Knoop.

In another example, the thermal conductivity of the coating varies with thickness in the coating. In different examples, the thermal conductivity of the coating increases with distance from the interface between the coating and the gun barrel, decreases with distance from the interface between the coating and the gun barrel, or is higher in the central portion of the coating than at either the surface of the coating or at its interface with the gun barrel. In embodiments, the increase or decrease in thermal conductivity is gradual, such as a decrease or increase of less than 5 Btu/hr ° F. ft over a distance of 10 micrometers.

In other examples, the composition of the metallic coating varies across the thickness. In a specific example, the variation in composition is gradual, such as a variation in the amount of a given element is less than or equal to 3 wt % over a distance of 10 micrometers or less than or equal to 8 wt % over a distance of 50 micrometers or less. In other embodiments, the variation in the amount of a given element is less than or equal to 3 wt % or less than or equal to 8 wt % between two adjacent layers. In embodiments, the metallic coating is compositionally graded.

In some embodiments, the metallic coating comprises a single metallic layer. In other embodiments, the metallic coating is a multilayered coating which comprises a plurality of metallic layers. In some embodiments, at least two of the layers have different properties. In further embodiments, each of the layers of the coating has different properties. As examples, layers of the coating may vary in composition, thermal conductivity, hardness, wear resistance and/or ductility. In an embodiment, the number of layers is from 2 to 15.

In embodiments, the invention provides a gun barrel comprising a metallic coating on at least a portion of the inner surface of the gun barrel, the coating comprising a first metallic component selected from the group consisting of Ta, Nb, Zr, Re, Hf, W and combinations thereof; a second metallic component which is molybdenum and an optional third metallic component which is titanium. In some embodiments, the coating comprises a solid-state solution including the first metallic component and molybdenum. In additional embodiment, the solid-state solution also includes titanium. In some embodiments, the first metallic component is a combination of at least two of tantalum (Ta), niobium (Nb), zirconium (Zr), rhenium (Re), hafnium (Hf) or tungsten (W). In examples, the first metallic component comprises a combination of tantalum and hafnium, niobium and tantalum, tantalum and zirconium, or niobium, tantalum and zirconium. In some embodiments, the metallic elements being combined in the first metallic component are present in equal amounts. In other embodiments, one metallic element is present in larger amounts than the other metallic element(s) in the first metallic component.

In some embodiments, the coating comprises a single layer of the first metallic component, molybdenum and optionally titanium while in other embodiments, the coating comprises a plurality of layers of the first metallic component, molybdenum and optionally titanium. In further embodiments, other layers are included in combination with the one or more layers of the first metallic component, molybdenum and optionally titanium as described in more detail below.

In some embodiments, the composition of the coating or a given layer of the coating is substantially uniform across the thickness of the coating or the given layer of the coating. For example, the variation in the average amount of each element in the coating or the given layer of the coating may vary by less than or equal to 5 wt % across the thickness of the coating or the given layer of the coating. In other embodiments, the composition of the coating varies across the thickness of the coating. In some embodiment, the average amount of each of at least two elements varies through a layer of the coating or through the thickness of the coating For example, the average amount of a first element may increase with increasing depth in the coating while the average amount of a second element may decrease with increasing depth in the coating. In some embodiments, multiple layers, each layer being substantially uniform in composition but having a composition different from another layer in the coating, are used to achieve the variation in composition.

In different embodiments the coating or a given layer of the first metallic component, molybdenum and optionally titanium comprises at least 95%, at least 98% or at least 99% or at least 99.9% of a solid state solution phase comprising the first metallic component, molybdenum and titanium (if present in the layer). In embodiments, the coating or a given layer of the coating consists essentially of a solid-state compositionally homogeneous solution of the first metallic component, molybdenum and titanium (if present in the layer). In embodiments, the solid state solution consists essentially of well-defined euhedral crystal shapes and is absent any micro- or macro-fissures. In some embodiments, the coating or a given layer of the coating has a body-centered cubic (BCC) structure. In additional embodiments, the coating or a given layer of the coating has a hexagonal close-packed (HCP) structure.

In some embodiments, the coating or a given layer of the coating is predominantly of the first metallic component, with the amount of the first metallic component being greater than the amount of any other element present in the coating. In an embodiment, the amount of molybdenum is less than 50 wt %. In an embodiment, the amount of molybdenum is greater than 10 wt %. If present, in different embodiments the amount of titanium is from 3% to 35%, greater than or equal to 5 wt % and less than or equal to 25 wt % or greater than or equal to 10 wt % and less than or equal to 25 wt %. In an embodiment, the total weight percentage of the first metallic component, molybdenum and titanium is greater than or equal to 95 wt %, 98 wt % or 99 wt %.

In an aspect, the disclosure provides a coated gun barrel comprising a metallic coating on at least a portion of the inner surface of the gun barrel, the coating further comprising a layer, the layer comprising:

a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum (Mo)

wherein in the layer the average amount of molybdenum is greater than or equal to 10 wt %, the average amount of the first metallic component is greater than the amount of molybdenum, the total weight percentage of the first metallic component and molybdenum is greater than or equal to 95 wt % and the layer comprises at least 95% of a solid solution phase comprising the first metallic component and molybdenum.

In some embodiments, the layer or the solid solution phase comprises 51 wt % to 90 wt %, 55 wt % to 90 wt %, 60 wt % to 90 wt %, or 65 wt % to 90 wt % of the first metallic component and 10 wt % to 49 wt %, 10 wt % to 45 wt %, 10 wt % to 40 wt %, or 10 wt % to 35 wt % of molybdenum. In additional embodiments the layer or the solid solution phase comprises 51 wt % to 75 wt %, 55 wt % to 75 wt %, 60 wt % to 75 wt %, or 65 wt % to 75 wt % of the first metallic component and 25 wt % to 49 wt %, 25 wt % to 45 wt %, 25 wt % to 40 wt %, or 25 wt % to 35 wt % of molybdenum.

In further embodiments, the disclosure provides a coated gun barrel comprising a metallic coating on at least a portion of the inner surface of the gun barrel, the coating comprising a layer, the layer comprising:

a) a first metallic component selected from the group consisting of tantalum (Ta), niobium (Nb), zirconium (Zr), rhenium (Re), hafnium (Hf), tungsten (W) and combinations thereof;

b) a second metallic component which is molybdenum; and c) a third metallic component which is titanium wherein in the layer the average amount of titanium is greater than 3 wt % and less than 35 wt %, the average amount of molybdenum is greater than or equal to 10 wt %, the average amount of the first metallic component is greater than the amount of molybdenum and greater than the amount of titanium, the total weight percentage of the first metallic component, molybdenum and titanium is greater than or equal to 95 wt % and the layer comprises at least 95% of a solid solution phase comprising the first metallic component, molybdenum and titanium.

In some embodiments, the layer or the solid solution phase comprises 51 wt % to less than 87 wt %, 55 wt % to less than 87 wt %, 60 wt % to less than 87 wt %, or 65 wt % to less than 87 wt % of the first metallic component and greater than 13 wt % to 49 wt %, greater than 13 wt % to 45 wt %, greater than 13 wt % to 40 wt %, or greater than 13 wt % to 35 wt % of molybdenum and titanium together. In additional embodiments the layer or the solid solution phase comprises 51 wt % to 75 wt %, 55 wt % to 75 wt %, 60 wt % to 75 wt %, or 65 wt % to 75 wt % of the first metallic component and 25 wt % to 49 wt %, 25 wt % to 45 wt %, 25 wt % to 40 wt %, or 25 wt % to 35 wt % of molybdenum and titanium together. In some embodiments, the amount of molybdenum is greater than the amount of titanium.

In another embodiment, the coating or a given layer of the coating is predominantly molybdenum, with the amount of the molybdenum being greater than the amount of any other element present in the coating. In an embodiment, the amount of the first metallic component is less than 50 wt %. In an embodiment, the amount of first metallic component is greater than or equal to 10%. If present, in different embodiments the amount of titanium is greater than or equal to 3 wt % and less than or equal to 35 wt % or greater than or equal to 10 wt % and less than or equal to 25 wt %. In an embodiment, the total weight percentage of first metallic component, molybdenum and titanium is greater than or equal to 95 wt %, 98 wt % or 99 wt %.

In a further aspect, the disclosure provides a coated gun barrel comprising a metallic coating on at least a portion of the inner surface of the gun barrel, the coating further comprising a layer, the layer comprising:

a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum wherein in the layer the average amount of the first metallic component is greater than or equal to 10 wt %, the average amount of the molybdenum is greater than the amount of the first metallic component, the total weight percentage of the first metallic component and molybdenum is greater than or equal to 95 wt % and the layer comprises at least 95% of a solid solution phase comprising the first metallic component and molybdenum.

In some embodiments, the layer or the solid solution phase comprises 51 wt % to 90 wt %, 55 wt % to 90 wt %, 60 wt % to 90 wt %, or 65 wt % to 90 wt % of the molybdenum and 10 wt % to 49 wt %, 10 wt % to 45 wt %, 10 wt % to 40 wt %, or 10 wt % to 35 wt % of the first metallic component. In additional embodiments the layer or the solid solution phase comprises 51 wt % to 75 wt %, 55 wt % to 75 wt %, 60 wt % to 75 wt %, or 65 wt % to 75 wt % of the molybdenum, and 25 wt % to 49 wt %, 25 wt % to 45 wt %, 25 wt % to 40 wt %, or 25 wt % to 35 wt % of first metallic component In a further aspect, the disclosure provides a coated gun barrel comprising a metallic coating on at least a portion of the inner surface of the gun barrel, the coating further comprising a layer, the layer comprising a) a first metallic component selected from the group consisting of tantalum (Ta), niobium (Nb), zirconium (Zr), rhenium (Re), hafnium (Hf), tungsten (W) and combinations thereof;

b) a second metallic component which is molybdenum; and c) a third metallic component which is titanium wherein in the solid solution phase the average amount of titanium is greater than 3 wt % and less than 35 wt %, the average amount of the first metallic component is greater than or equal to 10 wt %, the average amount of molybdenum is greater than the amount of the first metallic component and greater than the amount of titanium, the total weight percentage of the first metallic component, molybdenum and titanium is greater than or equal to 95 wt % and the layer comprises at least 95% of a solid solution phase comprising the first metallic component, molybdenum and titanium.

In embodiments, the metallic coating comprises a plurality of metallic layers. In some embodiments, the coating comprises at least one layer comprising the first metallic component and molybdenum and at least one layer comprising the first metallic component, molybdenum and titanium. In further embodiments, the coating comprises at least one layer comprising the first metallic component, molybdenum and optionally titanium and one or more additional metallic layers, wherein at least one of the additional layers is a substantially pure metal selected from the group consisting of Ta, Nb, Zr, Re, and Hf, substantially pure molybdenum, substantially pure titanium, a titanium alloy or a molybdenum alloy. Suitable titanium alloys for this layer include, but are not limited to Ti—Al—V, Ti—Pd, Ti—Ru and T-Cr, Suitable molybdenum alloys for this layer include, but are not limited to Mo—La and TMZ (alloy about 0.5 wt % Ti, about 0.08 wt % Zr and 0.02 wt % C, bal Mo), In a further aspect of the invention, the surface of the metallic coating is oxidized, carburized or nitrided after the coating is formed, thereby forming a coating comprising a non-metallic surface region or layer on the metallic coating. In examples, the non-metallic surface layer is a metal oxide, a metal carbide or a metal nitride. In different embodiments, the thickness of the coating comprising a non-metallic surface region and a metallic coating is from 10 μm to 2000 μm, 10 μm to 100 μm or 100 μm to 2000 μm.

In another aspect, the invention provides methods for making coated gun barrels. In an embodiment, the invention provides a method for making a coated gun barrel comprising the step of putting material onto the inner surface of a gun barrel, the material comprising a first metallic component selected from the group consisting of Ta, Nb, Zr, Re, Hf, W and combinations thereof; molybdenum and optionally titanium. In an embodiment the invention provides a method for making a gun barrel comprising a finishing step of material removal (cutting, broaching, polishing, lapping, etc.) from coated inner surface of a gun barrel for shaping, higher dimensional tolerances or improved surface finish. In different embodiments, the coating comprises one or more of the features described herein with respect to the coated gun barrels of the invention.

BRIEF DESCRIPTION OF THE DRAWINGS

FIG. 3B shows the elemental peaks identified in the sample through Energy Dispersive Spectroscopy (EDS). FIG. 3B shows the variation in the intensity of selected elemental peaks as a function of distance.

DETAILED DESCRIPTION OF THE INVENTION

Figure 1A:
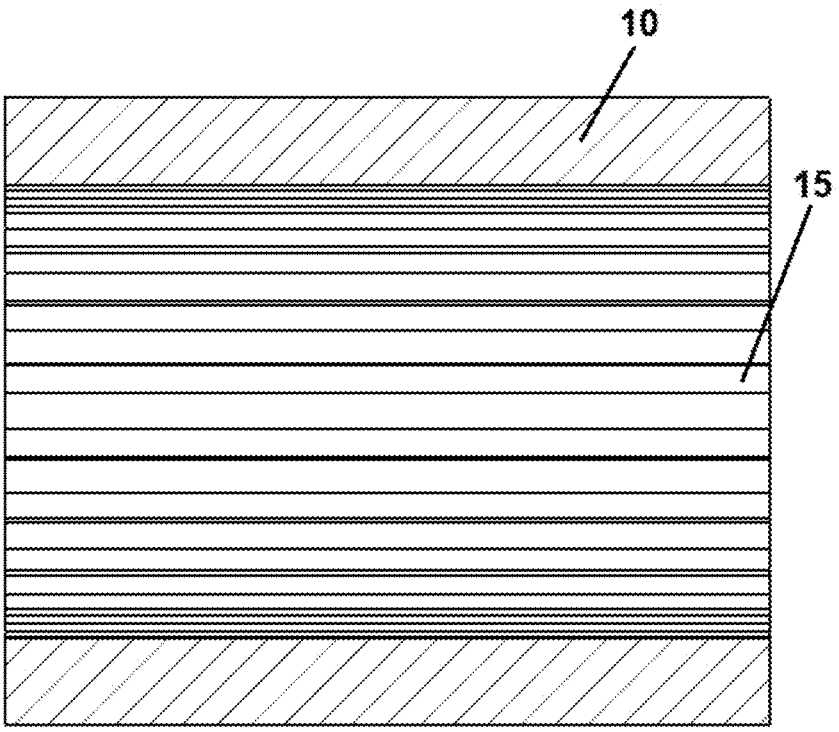
FIG. 1A provides a schematic longitudinal cross-section view of a gun barrel (10) coated with a coating material.
Figure 1B:
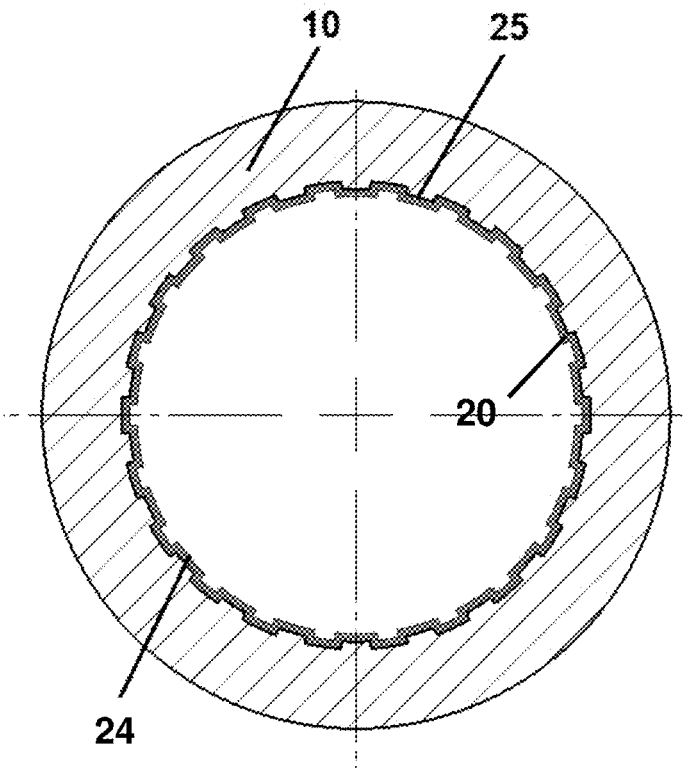
FIG. 1B provides a schematic transverse cross-section view indicating the gun barrel and coating (20).
Figure 2:
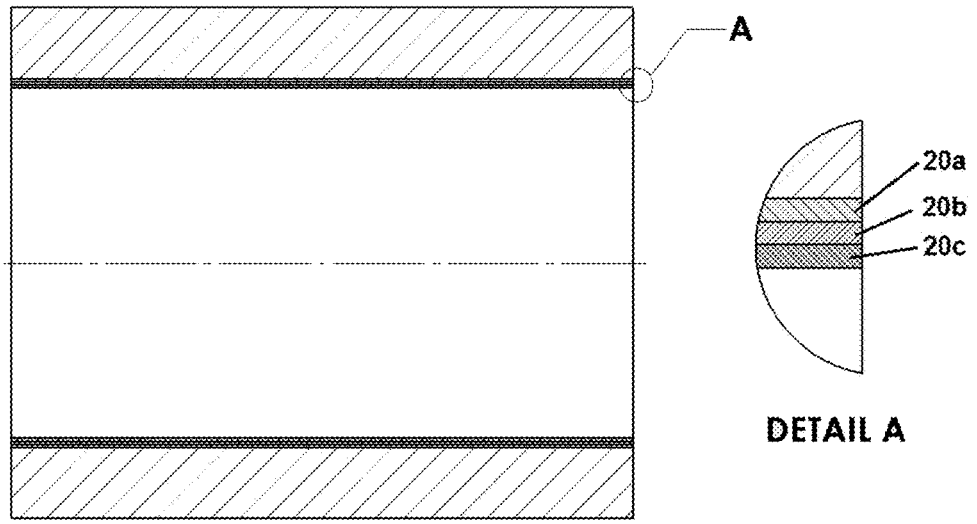
FIG. 2 provides a schematic longitudinal cross-section view of another gun barrel (10) coated with three layers of coating material (20*a*, 20*b*, 20*c*).

FIGS. 1A and 1B provide schematic longitudinal and transverse views of coated gun barrel. The gun barrel has an axial bore as shown in FIG. 1A. Rifling of the gun barrel in the forms of grooves is also schematically illustrated in FIG. 1B. The inner surface of the gun barrel (10) is coated with a coating material (20); the inner surface of the coated gun barrel is indicated by (15) in FIG. 1A. As shown in FIG. 1B, the surface of the coating is indicated by (24) and the interface between the gun barrel and the coating is indicated by (25). In an embodiment, the gun barrel is of steel. FIG. 2 is a schematic longitudinal view of another coated gun barrel. Detail A of FIG. 2 shows three layers of coating material (20*a*, 20*b*, and 20*c*). The outer layer of the coating material 20*c* forms the surface of the coating, while the inner layer of the coating material 20*a* forms an interface with the gun barrel.

The coating comprises at least one layer of coating material. In an embodiment, the coating material comprises a solid-state solution of at least one first metallic component, molybdenum and optionally titanium. As used herein, a solid-state solution refers to a homogeneous solid mixture. A solid-state solution has a single phase structure. In an embodiment, the crystal lattice of the solid-state solution is the same as that of the dominant component of the solution. In an embodiment, a composition is substantially a solid-state solution when the amount of additional phases is less than 0.1 wt % or 1 wt %. In another embodiment, a composition is substantially a solid-state solution when no second phase is detected. In an embodiment, the interface between the coating and the inner surface of gun barrel is sharp. For example, the transition region between the coating and the inner surface of the gun barrel may be about 10 microns or less or about 5 microns or less.

In an embodiment, the coating comprises a plurality of layers, at least two of the layers having a different average composition. In an embodiment, at least one of the layers is a substantially pure metal selected from the group consisting of Ta, Nb, Zr, Re, and Hf, substantially pure molybdenum or substantially pure titanium. In different embodiments, a layer of a substantially pure element includes at least 95 wt %, at least 98 wt % or at least 99 wt % of the element in the coating. The interface between coating layers is sharp.

In an embodiment, the hardness of various regions of the coating is determined with an indentation technique from a cross-section through the coating. In an embodiment, the hardness of the inner surface of the coating (at the interface with the gun barrel) is from 360 to 800 Knoop. In an embodiment, the hardness of the mid-zone of the coating is from 800 to 1400 Knoop. In another embodiment, the hardness of the outer surface of the coating is from 360 to 800 Knoop.

In an embodiment, the coating material is put on the inner surface of a gun barrel as mechanical insert or by means of explosive bonding, chemical vapor deposition, physical vapor deposition, plasma spray or other material deposition/bonding techniques known in the art. In embodiments, the deposition process is selected to limit metal oxidation. Physical vapor deposition techniques include sputter deposition. As used herein, sputter deposition extends to all types of sputtering and combinations thereof. US Patent Application Publication No. US 2009/0145743 (Yumshtyk et al.) and U.S. Pat. No. 4,407,713 (Zega) and U.S. Pat. No. 6,436,252 (Tzatzov et al.) are hereby incorporated by reference for their description of magnetron sputtering methods and apparatus.

All references cited herein are hereby incorporated by reference to the extent not inconsistent with the disclosure herewith.

Although the description herein contains many specificities, these should not be construed as limiting the scope of the invention but as merely providing illustrations of some of the presently preferred embodiments of the invention. For example, thus the scope of the invention should be determined by the appended claims and their equivalents, rather than by the examples given.

Every formulation or combination of components described or exemplified can be used to practice the invention, unless otherwise stated. Specific names of compounds are intended to be exemplary, as it is known that one of ordinary skill in the art can name the same compounds differently. When a compound is described herein such that a particular isomer or enantiomer of the compound is not specified, for example, in a formula or in a chemical name, that description is intended to include each isomers and enantiomer of the compound described individual or in any combination. One of ordinary skill in the art will appreciate that methods, device elements, starting materials and synthetic methods, other than those specifically exemplified can be employed in the practice of the invention without resort to undue experimentation. All art-known functional equivalents, of any such methods, device elements, starting materials and synthetic methods are intended to be included in this invention. Whenever a range is given in the specification, for example, a temperature range, a time range, or a composition range, all intermediate ranges and subranges, as well as all individual values included in the ranges given are intended to be included in the disclosure.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements. The invention illustratively described herein suitably may be practiced in the absence of any element or elements, limitation or limitations which is not specifically disclosed herein.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In general the terms and phrases used herein have their art-recognized meaning, which can be found by reference to standard texts, journal references and contexts known to those skilled in the art. Any preceding definitions are provided to clarify their specific use in the context of the invention.

The invention may be further understood by the following non-limiting examples.

Example 1

A coating was deposited via physical vapor deposition on a steel gun barrel. Table 1 gives a measurement of the coating composition as measured with EDS. The hardness of the coating surface was approximately 750 on the Knoop scale.

Figure 3A:
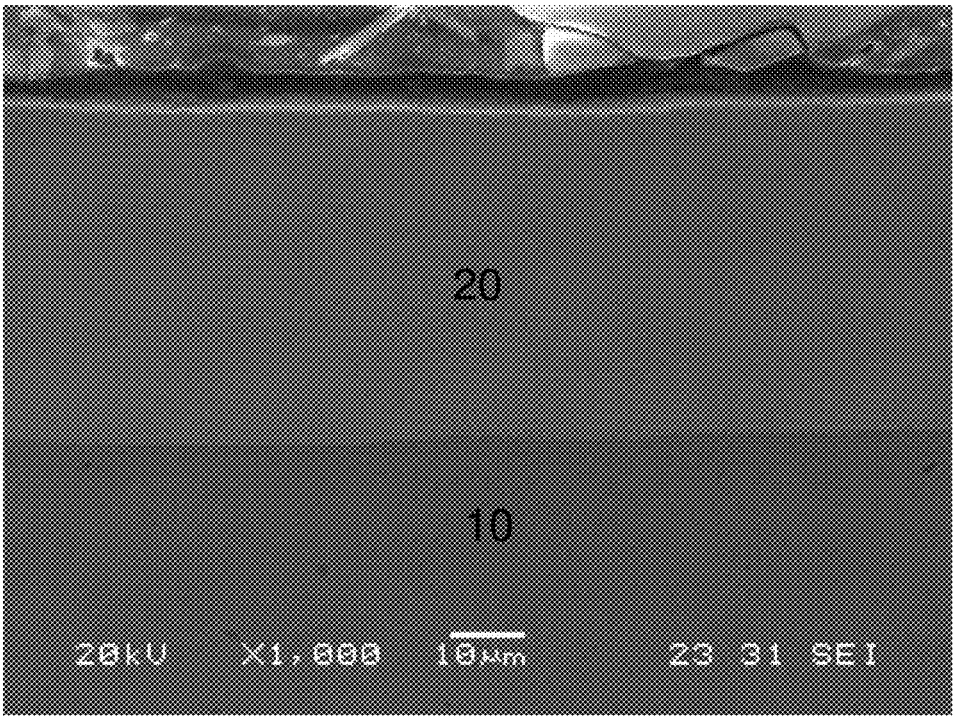
FIG. 3A is a back-scattered electron image of a NbMo alloy.

FIG. 3A shows a backscattered electron (BSE) image of a cross-section made to expose the coating (20) and the substrate (10). The coating was dense and uniform. No voids or other non-uniformities were observed. The coating was 90 to 100 microns thick.

FIG. 3B shows a spectrum obtained in the coating area. The dominant peaks were for molybdenum and niobium.

Figure 3C:
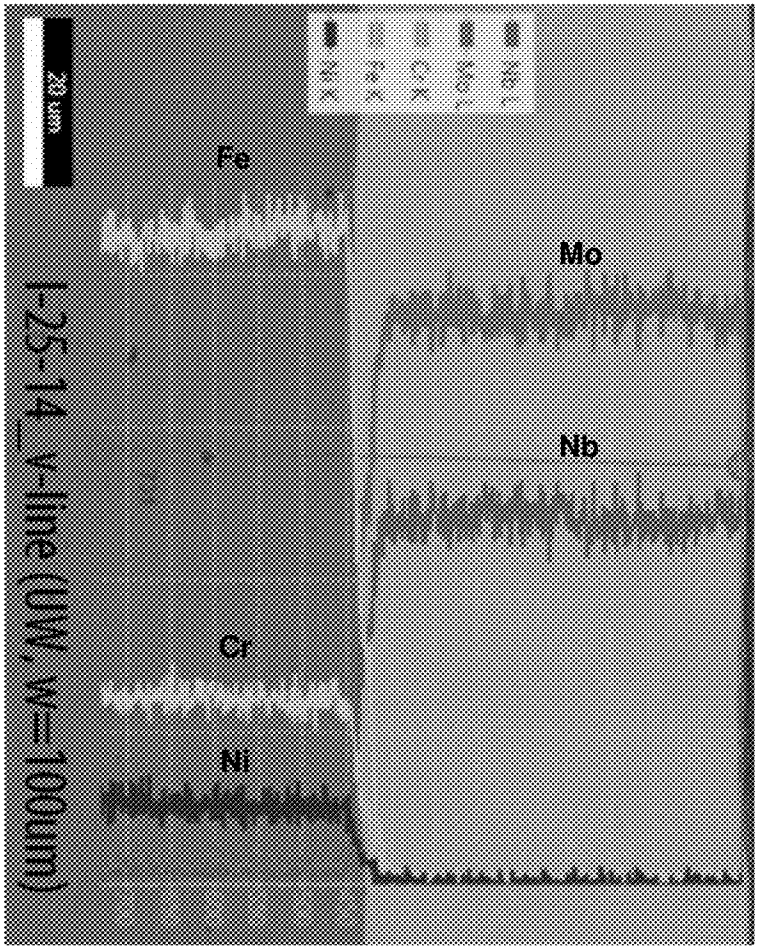
FIG. 3C shows the variation in peak intensity as a function of distance for niobium, molybdenum, chromium, iron and nickel.

FIG. 3C shows the variation in peak intensity as a function of distance for niobium (L peak), molybdenum (L peak), chromium (K peak), iron (K peak) and nickel (K peak). The peak intensities for iron, chromium and nickel rapidly decrease and the peak intensities for molybdenum and niobium rapidly increase at the interface between the steel substrate and the coating. The transition region is approximately 5 microns wide.

TABLE 1

| Element | Wt % | At % |
|---|---|---|
| Fe | 0.08 | 0.14 |
| Mo | 65.77 | 65.04 |
| Ta | 0.10 | 0.05 |
| Nb | 34.05 | 34.77 |

The invention claimed is:

1. A coated steel gun barrel comprising a metallic coating on at least a portion of the inner surface of the gun barrel, the coating further comprising a layer, the layer comprising:

a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum (Mo)

wherein in the layer the average amount of molybdenum is greater than or equal to 10 wt %, the average amount of the first metallic component is greater than the amount of molybdenum and the total weight percentage of the first metallic component and molybdenum is greater than or equal to 95 wt % and the layer comprises at least 95% of a solid solution phase comprising the first metallic component and molybdenum and wherein a transition region is formed between the coating and the inner surface of the gun barrel, the thickness of the transition region being 5 micrometers or less.

2. The coated gun barrel of claim 1, wherein the solid solution phase comprises 51 wt % to 75 wt % of the first metallic component and 25 wt % to 49 wt % of molybdenum.

3. The coated gun barrel of claim 1, wherein the first metallic component is a combination of at least two of Tantalum (Ta), Niobium (Nb), Zirconium (Zr), Rhenium (Re), Hafnium (Hf) or Tungsten (W).

4. The coated gun barrel of claim 1, wherein the coating comprises a plurality of layers comprising a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum (Mo)

wherein in each layer the average amount of molybdenum is greater than or equal to 10 wt %, the average amount of the first metallic component is greater than the amount of molybdenum and the total weight percentage of the first metallic component and molybdenum is greater than or equal to 95 wt %, each layer comprises at least 95% of a solid solution phase comprising the first metallic component and molybdenum, and at least two of the layers are different in composition.

5. The coated gun barrel of claim 1, wherein the hardness of the coating surface is from 350 Knoop to 1400 Knoop.

6. The coated gun barrel of claim 1, wherein the coating further comprises a layer of substantially pure titanium or a titanium alloy.

7. The coated gun barrel of claim 1, wherein the thickness of the coating is from 10 microns to 2000 microns.

8. The coated gun barrel of claim 1, wherein the inner surface of the gun barrel is rifled.

9. The coated gun barrel of claim 1, wherein the coating is graded in composition, hardness or thermal conductivity.

10. The coated gun barrel of claim 9, wherein the amount of at least one metallic component of the coating decreases from the coating surface to the interface of the coating with gun barrel, the amount of at least one metallic component of the coating increases from the coating surface to the interface of the coating with gun barrel, or wherein the coating comprises a center region and the amount of at least one metallic component of the coating decreases from the center region to the coating surface and from the center region to the interface of the coating with gun barrel.

11. The coated gun barrel of claim 9, wherein the hardness of the coating decreases from the coating surface to the interface of the coating with gun barrel, the hardness increases from the coating surface to the interface of the coating with gun barrel, or wherein the coating comprises a center region and the hardness of the coating decreases from the center region to the coating surface and from the center region to the interface of the coating with gun barrel.

12. The coated gun barrel of claim 9, wherein the thermal conductivity of the coating decreases from the coating surface to the interface of the coating with gun barrel, the thermal conductivity increases from the coating surface to the interface of the coating with gun barrel, or wherein the coating comprises a center region and the thermal conductivity of the coating decreases from the center region to the coating surface and from the center region to the interface of the coating with gun barrel.

13. A coated steel gun barrel comprising a metallic coating on at least a portion of the inner surface of the gun barrel, the coating comprising a layer, the layer comprising:

a) a first metallic component selected from the group consisting of tantalum (Ta), niobium (Nb), zirconium (Zr), rhenium (Re), hafnium (Hf), tungsten (W) and combinations thereof;

b) a second metallic component which is molybdenum; and c) a third metallic component which is titanium wherein in the layer the average amount of titanium is greater than 3 wt % and less than 35 wt %, the average amount of molybdenum is greater than or equal to 10 wt %, the average amount of the first metallic component is greater than the amount of molybdenum and greater than the amount of titanium and the total weight percentage of the first metallic component, molybdenum and titanium is greater than or equal to 95 wt % and the layer comprises at least 95% of a solid solution phase comprising the first metallic component, molybdenum and titanium and wherein a transition region is formed between the coating and the inner surface of the gun barrel, the thickness of the transition region being 5 micrometers or less.

14. The coated gun barrel of claim 13, wherein the solid solution phase comprises 51 wt % to 75 wt % of the first metallic component, and 25 wt % to 49% wt % of molybdenum and titanium together.

15. The coated gun barrel of claim 13 wherein the first metallic component is a combination of at least two of Tantalum (Ta), Niobium (Nb), Zirconium (Zr), Rhenium (Re), Hafnium (Hf) or Tungsten (W).

16. A coated steel gun barrel comprising a metallic coating on at least a portion of the inner surface of the gun barrel, the coating further comprising a layer, the layer comprising:

a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum wherein in the layer the average amount of the first metallic component is greater than or equal to 10 wt %, the average amount of the molybdenum is greater than the amount of the first metallic component, the total weight percentage of the first metallic component and molybdenum is greater than or equal to 95 wt % and the layer comprises at least 95% of a solid solution phase comprising the first metallic component and molybdenum and wherein a transition region is formed between the coating and the inner surface of the gun barrel, the thickness of the transition region being 5 micrometers or less.

17. The coated gun barrel of claim 16, wherein the solid solution phase comprises 51 wt % to 75 wt % of molybdenum and 25 wt % to 49 wt % of the first metallic component.

18. The coated gun barrel of claim 16, wherein the first metallic component is a combination of at least two of Tantalum (Ta), Niobium (Nb), Zirconium (Zr), Rhenium (Re), Hafnium (Hf), Tungsten (W).

19. The gun barrel of claim 16 wherein the coating comprises a plurality of layers comprising a) a first metallic component selected from the group consisting of tantalum (Ta), niobium (Nb), zirconium (Zr), rhenium (Re), hafnium (Hf), tungsten (W) and combinations thereof; and b) a second metallic component which is molybdenum (Mo)

wherein in each layer the average amount of the first metallic component is greater than or equal to 10 wt %, the average amount of molybdenum is greater than the amount of the first metallic component, the total weight percentage of the first metallic component and molybdenum is greater than or equal to 95 wt %, each layer comprises at least 95% of a solid solution phase comprising the first metallic component and molybdenum, and at least two of the layers are different in composition.

20. The coated gun barrel of claim 16, wherein the hardness of the coating surface is from 800 Knoop to 1400 Knoop.

21. The gun barrel of claim 16 wherein the coating further comprises a layer of substantially pure titanium or a titanium alloy.

22. The coated gun barrel of claim 16, wherein the thickness of the coating is from 10 microns to 2000 microns.

23. The coated gun barrel of claim 16 wherein the inner surface of the gun barrel is rifled.

24. The coated gun barrel of claim 16, wherein the coating is graded in composition, hardness or thermal conductivity.

25. The coated gun barrel of claim 24, wherein the amount of at least one metallic component of the coating decreases from the coating surface to the interface of the coating with gun barrel, the amount of at least one metallic component of the coating increases from the coating surface to the interface of the coating with gun barrel, or wherein the coating comprises a center region and the amount of at least one metallic component of the coating decreases from the center region to the coating surface and from the center region to the interface of the coating with gun barrel.

26. The coated gun barrel of claim 24, wherein the hardness of the coating decreases from the coating surface to the interface of the coating with gun barrel, the hardness of the coating increases from the coating surface to the interface of the coating with gun barrel, or wherein the coating comprises a center region and the hardness of the coating decreases from the center region to the coating surface and from the center region to the interface of the coating with gun barrel.

27. The coated gun barrel of claim 24, wherein the thermal conductivity of the coating decreases from the coating surface to the interface of the coating with gun barrel, the thermal conductivity of the coating increases from the coating surface to the interface of the coating with gun barrel, or wherein the coating comprises a center region and the thermal conductivity of the coating of the coating decreases from the center region to the coating surface and from the center region to the interface of the coating with gun barrel.

28. A coated steel gun barrel comprising a metallic coating on at least a portion of the inner surface of the gun barrel, the coating further comprising a layer, the layer comprising:

a) a first metallic component selected from the group consisting of tantalum (Ta), niobium (Nb), zirconium (Zr), rhenium (Re), hafnium (Hf), tungsten (W) and combinations thereof;

b) a second metallic component which is molybdenum; and c) a third metallic component which is titanium wherein in the layer the average amount of titanium is greater than 3 wt % and less than 35 wt %, the average amount of the first metallic component is greater than or equal to 10 wt %, the average amount of molybdenum is greater than the amount of the first metallic component and greater than the amount of titanium, the total weight percentage of the first metallic component, molybdenum and titanium is greater than or equal to 95 wt % and the layer comprises at least 95% of a solid solution phase comprising the first metallic component, molybdenum and titanium and wherein a transition region is formed between the coating and the inner surface of the gun barrel, the thickness of the transition region being 5 micrometers or less.

29. The coated gun barrel of claim 28, wherein the solid solution phase comprises 51 wt % to 75 wt % of the first metallic component, 25 wt % to 49% of molybdenum and titanium together.

30. The coated gun barrel of claim 28, wherein the first metallic component is a combination of at least two of Tantalum (Ta), Niobium (Nb), Zirconium (Zr), Rhenium (Re), Hafnium (Hf), Tungsten (W).

31. The coated gun barrel of claim 28, wherein the hardness of the coating surface is from 350 Knoop to 800 Knoop.

* * * * *